US009767953B2

(12) United States Patent
Fan et al.

(10) Patent No.: US 9,767,953 B2
(45) Date of Patent: Sep. 19, 2017

(54) COMMON MODE FILTER AND CORE THEREOF

(71) Applicant: ABC TAIWAN ELECTRONICS CORP., Taoyuan (TW)

(72) Inventors: Liang-Fang Fan, Taoyuan County (TW); Ming-Chien Hsiao, Hsinchu (TW); Tang-Kang Chen, Taoyuan County (TW)

(73) Assignee: ABC TAIWAN ELECTRONICS CORP., Taoyuan (TW)

( * ) Notice: Subject to any disclaimer, the term of this patent is extended or adjusted under 35 U.S.C. 154(b) by 29 days.

(21) Appl. No.: 14/571,586

(22) Filed: Dec. 16, 2014

(65) Prior Publication Data

US 2016/0172093 A1 Jun. 16, 2016

(51) Int. Cl.

| | |
|---|---|
| ***H01F 27/28*** | (2006.01) |
| ***H01F 27/29*** | (2006.01) |
| ***H01F 27/02*** | (2006.01) |
| ***H01F 17/04*** | (2006.01) |

(52) U.S. Cl.
CPC ..... *H01F 27/2828* (2013.01); *H01F 17/045* (2013.01)

(58) Field of Classification Search
CPC ..... H01F 17/045; H01F 2017/0093; H01F 41/07; H01F 27/28; H01F 27/2823
USPC ..... 336/220, 83, 192
See application file for complete search history.

(56) References Cited

U.S. PATENT DOCUMENTS

| | | | | |
|---|---|---|---|---|
| 6,825,748 | B1 * | 11/2004 | Ibata | H01F 17/045 29/602.1 |
| 7,932,803 | B2 * | 4/2011 | Hirai | H01F 17/045 29/602.1 |
| 8,093,980 | B2 * | 1/2012 | Asou | H01F 17/045 336/192 |
| 2002/0021201 | A1 * | 2/2002 | Ol | H01F 3/14 336/197 |
| 2008/0309445 | A1 * | 12/2008 | Suzuki | H01F 41/069 336/183 |
| 2009/0195342 | A1 * | 8/2009 | Azuma | H01F 27/292 336/192 |
| 2010/0109827 | A1 * | 5/2010 | Asou | H01F 17/045 336/192 |
| 2010/0148912 | A1 * | 6/2010 | Nakatani | H01F 17/04 336/220 |
| 2013/0229254 | A1 * | 9/2013 | Lee | H01F 27/2828 336/220 |

(Continued)

*Primary Examiner* — Tsz Chan
*Assistant Examiner* — Kazi Hossain

(57) ABSTRACT

A common mode filter, comprising a winding core, and said winding core further includes a U-type heave portion, said U-type heave portion divides said winding core into a first winding portion, a second winding portion and a cross winding portion; the first winding wires, are wound on said first winding portion, said cross winding portion and said second winding portion in sequence; and the second winding wires, are wound on said first winding portion, said cross winding portion and said second winding portion in sequence. As a result, the common mode filter not only can reduce the effects of the existence capacitors of in high-frequency layers and the inherent functionality of parasitic capacitors in common mode filters with higher frequency characteristics, but also the overall structure is simple, fast assembly and easy operation.

12 Claims, 9 Drawing Sheets

(56) References Cited

U.S. PATENT DOCUMENTS

| | | | | |
|---|---|---|---|---|
| 2014/0097928 | A1* | 4/2014 | Tomonari | H01F 27/28<br>336/207 |
| 2014/0167903 | A1* | 6/2014 | Tomonari | H01F 17/045<br>336/220 |
| 2014/0253276 | A1* | 9/2014 | Iwasaki | H01F 27/2804<br>336/200 |
| 2014/0268944 | A1* | 9/2014 | Fornage | H01F 27/343<br>363/55 |

* cited by examiner

400

600

800

COMMON MODE FILTER AND CORE THEREOF

BACKGROUND

Due to the development of wireless communication technology, more and more Ethernets are being used as an in-vehicle LAN. To enhance stable characteristics and reject higher common mode noise, a common mode filter has been widely adopted in in-vehicle LAN to negatively affect the effectiveness.

It is well known that a common mode filter is configured by two inductances magnetically coupled with each other and then inserted into the transmission line path to suppress common mode noise current.

FIG. 1 shows a first embodiment of the conventional common mode filter 1000. As shown in FIG. 1, the common mode filter 1000 includes a drum core 100, a first winding wires 10 and a second winding wires 20. In order to obtain two inductances magnetically coupled with each other, the first winding wires 10 and the second winding wires 20 are wound on the drum core 100 by the construction of single-layer pair of wires (SLPW). Both terminals of the first winding wires 10 and the second winding wires 20 are coupled with the electrode ends of the common mode filter 1000, respectively.

When a common current that includes some common noises passes through the common mode filter 1000, the same direction magnetically field will be induced in both winding wires 10 and 20. As a result, the inductive reactance of the first winding wires 10 and the second winding wires 20 will be increased. Furthermore, higher common independence characteristics will be presented in the common mode filter 1000 that is possible to selectively suppress and/or attenuate a common mode noise current.

The high common noise can be suppressed and/or attenuated in the disclosed the first embodiment of the conventional common mode filter 1000, however the first winding wires 10 and the second winding wires 20 are wound on said winding core 100 by single-layer pair of wires, this makes them costly, bulky and space-consuming. In other words, the impractical space utilization will result in the economic benefit being greatly downscaled.

FIG. 2 shows a second embodiment of the conventional common mode filter 2000. As shown in FIG. 2, the common mode filter 2000 includes a drum core 100, a first winding wires 10 and a second winding wires 20. In order to obtain two inductances magnetically coupled with each other, the first winding wires 10 and the second winding wires 20 are wound on the drum core 100 by the construction of double-layer pair with separate wires (DLPSW). Both terminals of the first winding wires 10 and the second winding wires 20 are coupled with the electrode of ends of the common mode filter 2000, respectively.

When a common current that includes some common noises passes through the common mode filter 2000, the same direction magnetically field will be induced in both winding wires 10 and 20. As a result, the inductive reactance of the first winding wires 10 and second winding wires 20 will be increased. Furthermore, higher common independence characteristics will be presented in the common mode filter 2000 that is possible to selectively suppress and/or attenuate a common mode noise current.

The high common noise can also be suppressed and/or attenuated in the disclosed second embodiment of the conventional common mode filter 1000. However, due to the first winding wires 10 and the second winding wires 20 are wound on said winding core 100 by double-layer structure, the existence capacitors of in high-frequency layers and the inherent functionality of parasitic capacitors in common mode filters with higher frequency characteristics results in the less attenuation of the common mode noise current.

FIG. 3 shows a third embodiment of the conventional common mode filter 3000. As shown in FIG. 3, the common mode filter 3000 includes a drum core 100, a first winding wires 10 and a second winding wires 20. In order to obtain two inductances magnetically coupled with each other, the first winding wires 10 and the second winding wires 20 are wound on the drum core 100 by the construction of double-layer pair of wires. Both terminals of the first winding wires 10 and the second winding wires 20 are coupled with the electrode of ends of the common mode filter 3000, respectively.

When a common current that includes some common noises passes through the common mode filter 3000, the same direction magnetically field will be induced in both winding wires 10 and 20. As a result, the inductive reactance of the first winding wires 10 and that second winding wires 20 will be increased. Furthermore, higher common independence characteristics will be presented in the common mode filter 3000 that is possible to selectively suppress and/or attenuate a common mode noise current.

Similarly, the high common noise can be suppressed and/or attenuated in the disclosed third embodiment of the conventional common mode filter 3000. However, due to the first winding wires 10 and the second winding wires 20 are wound on said winding core 100 by double-layer, the existence capacitors of in high-frequency layers and the inherent functionality of parasitic capacitors in common mode filters with higher frequency characteristics results in the less attenuation of the common mode noise current.

A variety of techniques can reduce and/or attenuate a common mode noise current. However, it is really the necessity, of implementing ways to reduce the cost drastically, shorten production time, and enhance the reproducibility of a common mode filter or layout design that must be considered addressing in the solution process.

SUMMARY

In one embodiment, a common mode filter for Ethernet is disclosed. The common mode filter, comprising a first flange, includes a first heave portion and a second heave portion; a second flange, includes a third heave portion and a fourth heave portion; a winding core, said first flange and said second flange are configured at the ends of said winding core, and said winding core further includes a U-type heave portion, said U-type heave portion divides said winding core into a first winding portion, a second winding portion and a cross winding portion; a first winding wires, are wound on said first winding portion, said cross winding portion and said second winding portion in sequence; and a second winding wires, are wound on said first winding portion, said cross winding portion and said second winding portion in sequence; wherein, numbers of turns of said first winding wires and said second winding wires provided on said cross winding portion are less than 1. As a result, the disclosed common mode filter not only can reduce the effects of the existence capacitors of in high-frequency layers and the inherent functionality of parasitic capacitors in common mode filters with higher frequency characteristics, but also the overall structure is simple, fast assembly and easy operation.

In another embodiment, a core of common mode filter is disclosed. The a core of common mode filter comprising a first flange, includes a first heave portion and a second heave portion; a second flange, includes a third heave portion and a fourth heave portion; and a winding core, said first flange and said second flange are configured at the ends of said winding core, and said winding core further includes a U-type heave portion, said U-type heave portion divides said winding core into a first winding portion, a second winding portion and a cross winding portion. As a result, the overall structure of the disclosed common mode filter is simple, fast assembly and easy operation.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

(FIG. 5 includes four figures: (a) down-sight view, (b) foresight view, (c) side-looking view, and (d) up-sight view)

(FIG. 7 includes four figures: (a) down-sight view, (b) foresight view, (c) side-looking view, and (d) up-sight view)

(FIG. 9 includes four figures: (a) down-sight view, (b) foresight view, (c) side-looking view, and (d) up-sight view)

DETAILED DESCRIPTION

Reference will now be made in detail to the embodiments of the present invention, examples of which are illustrated in the accompanying drawings. While the invention will be described in conjunction with the embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Figure 1:
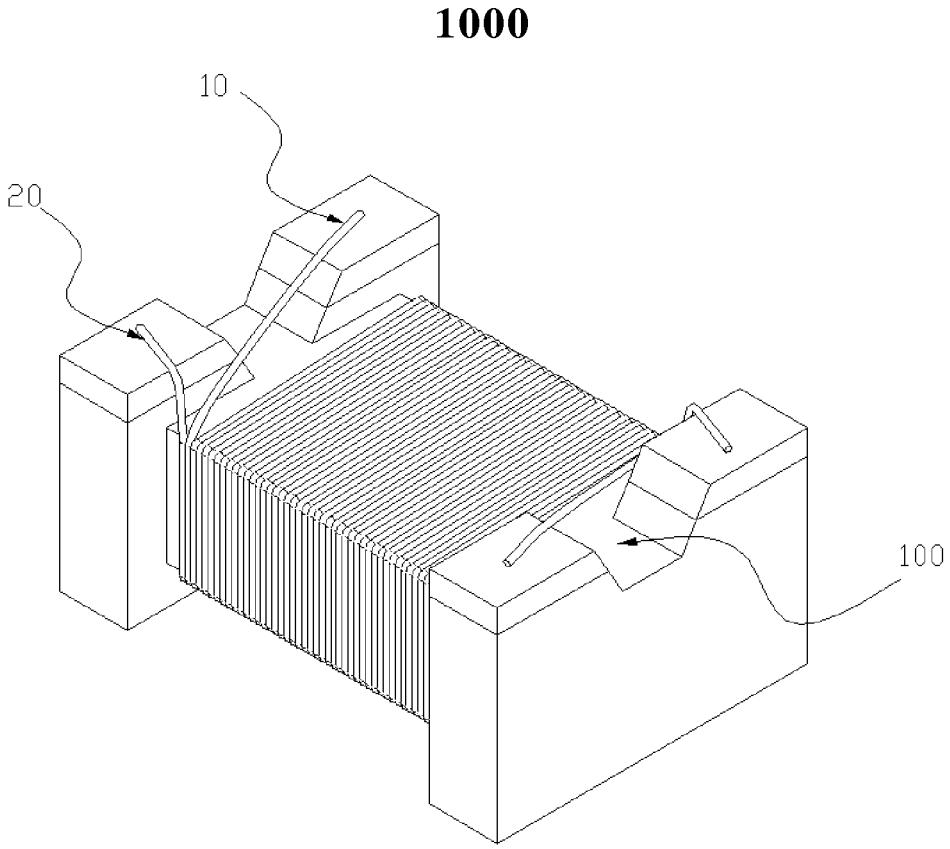
FIG. 1 shows an exemplary of a first embodiment of the conventional common mode filter.
Figure 2:
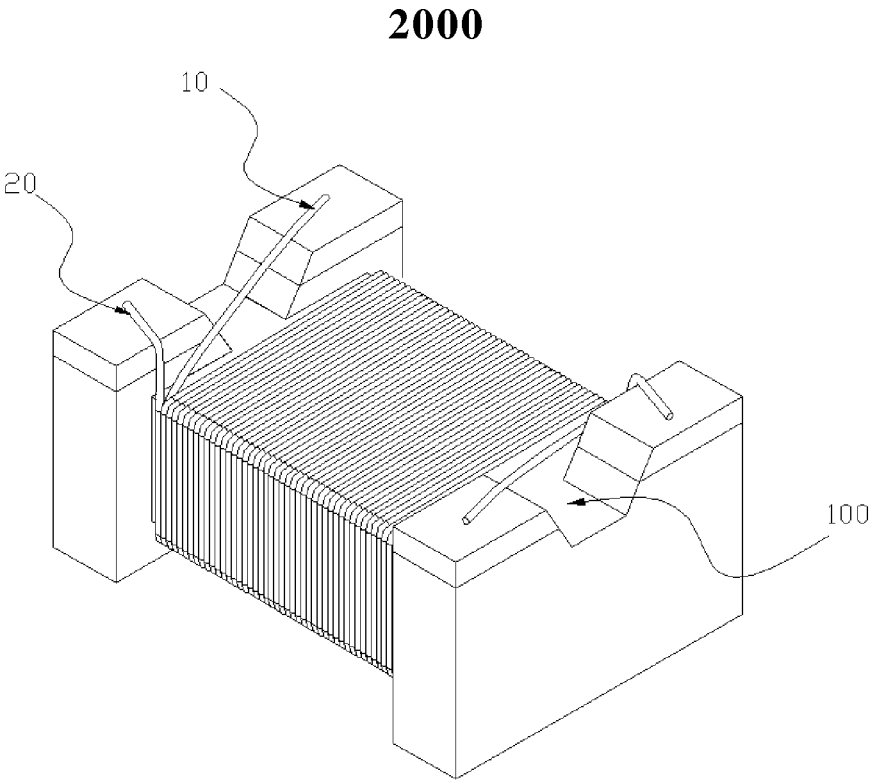
FIG. 2 shows an exemplary of a second embodiment of the conventional common mode filter.
Figure 3:
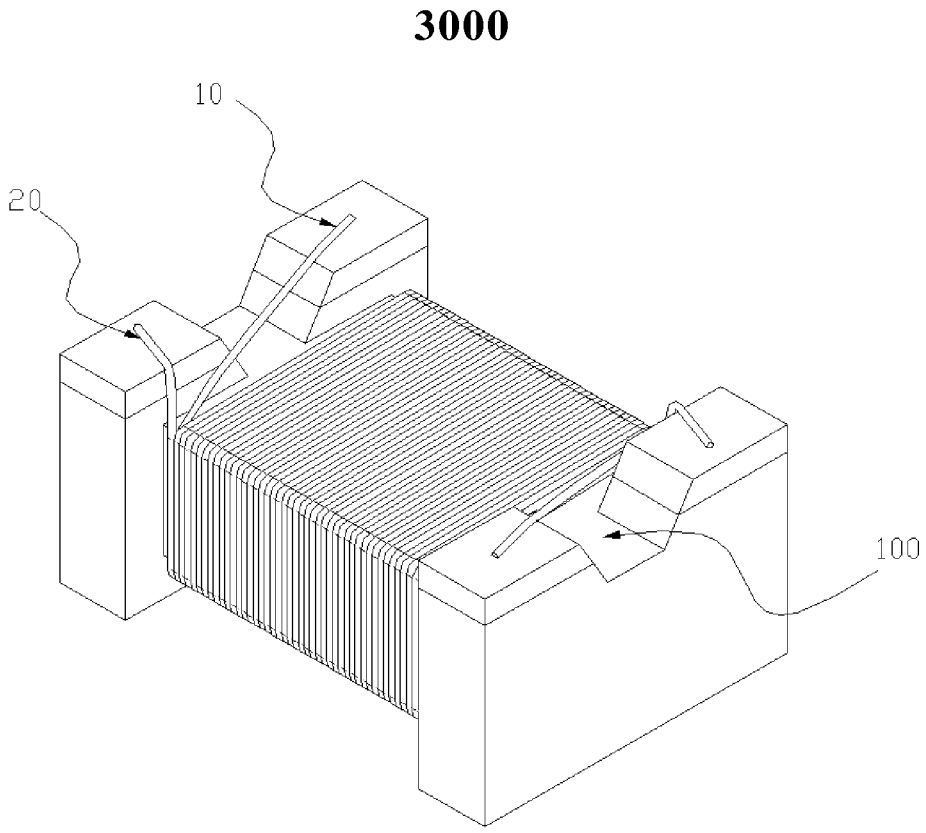
FIG. 3 shows an exemplary of a third embodiment of the conventional common mode filter.
Figure 4:
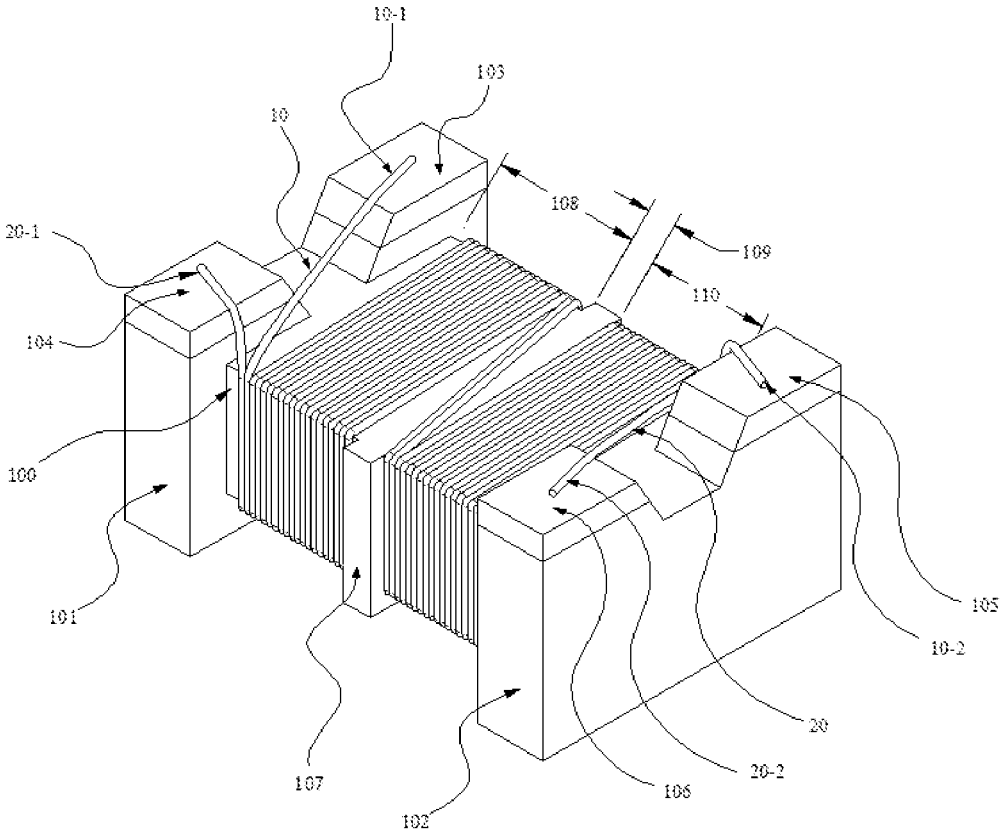
FIG. 4 illustrates a schematic perspective view of a common mode filter in accordance with the first embodiment of the present invention.
Figure 5:
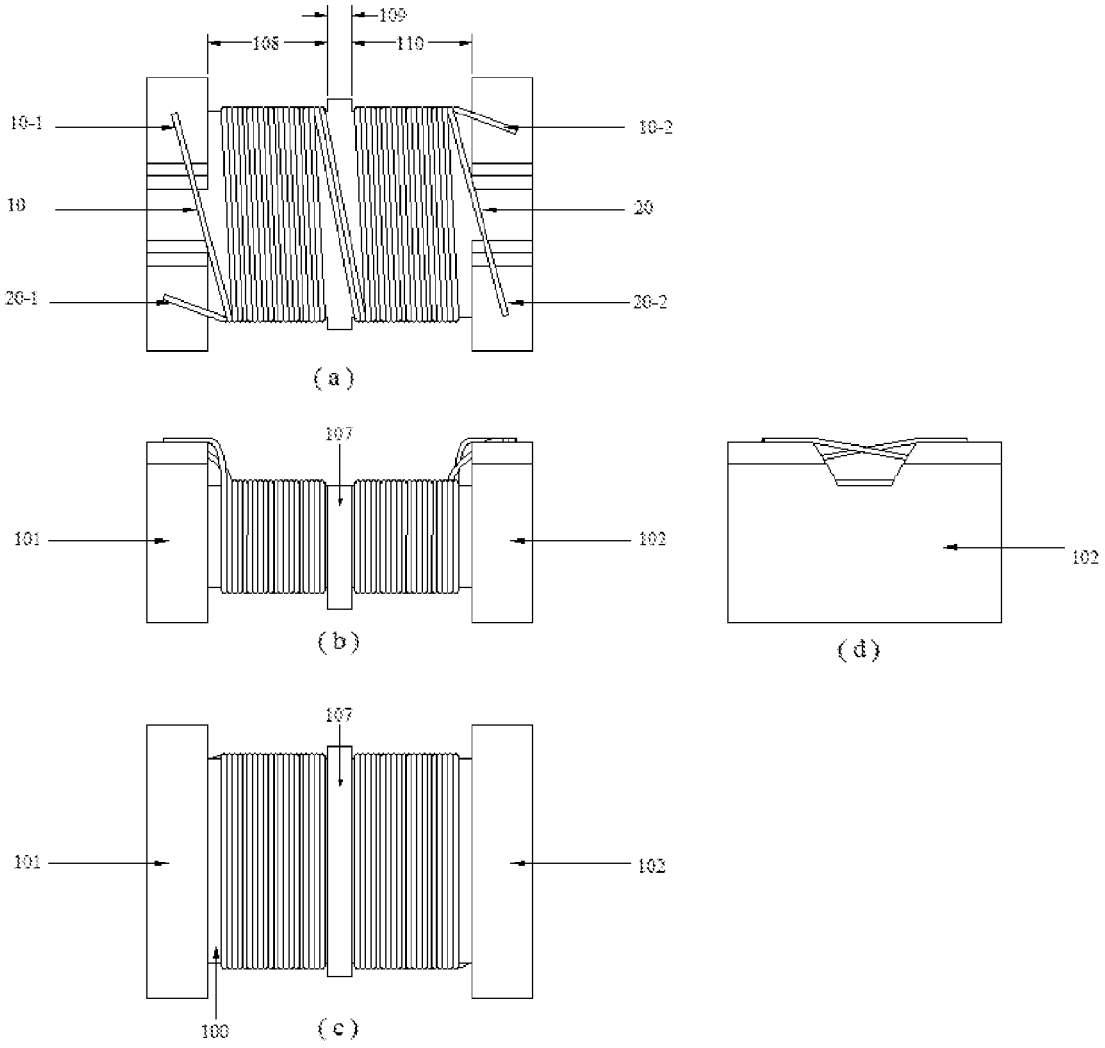
FIG. 5 illustrates plan views of the common mode filter shown in FIG. 4.

FIG. 4 illustrates a common mode in accordance with the first embodiment of the present invention 400. For clarity, FIG. 5 illustrates plan views of the common mode filter shown in FIG. 4, wherein FIG. 5 includes four figures: (a) down-sight view, (b) foresight view, (c) side-looking view, and (d) up-sight view.

The common mode filter includes a first flange 101 that includes a first heave portion 103 and a second heave portion 104; a second flange 102 that includes a third heave portion 105 and a fourth heave portion 106 and a winding core 100. The the first flange 101 and the second flange 102 are configured at the ends of the winding core 100. In one embodiment, the winding core 100 further includes a U-type heave portion 107 and the U-type heave portion 107 that divides the winding core 100 into a first winding portion 108, a second winding portion 109 and a cross winding portion 110.

The material of the winding core 100 is Ferrite. In one embodiment, the Ferrite is nickel-zinc (Ni—Zn), manganese-zinc (Mn—Zn) or Ceramic.

In order to obtain two inductances magnetically coupled with each other and reduce the effects of the existence capacitors of in high-frequency layers and the inherent higher frequency characteristics of parasitic capacitors in the common mode filter 400, a first winding wires 10 and a second winding wires 20 are simultaneously wound with adjacent on the surface of the first winding portion 108, the cross winding portion 109 and the second winding portion 110, in sequence. In one embodiment, numbers of turns of the first winding wires 10 and the second winding wires 20 provided on the cross winding portion 109 are less than 1. In another embodiment, the numbers of turns of the first winding wires 10 and the second winding wires 20 provided on the winding core 100 are substantially the same.

The first heave portion 103, the second heave portion 104, the third heave portion 105 and the fourth heave portion 106 further include a metal terminal (not shown here). In one embodiment, the material of the metal terminal is composed by silver, nickel and gold or by silver, nickel and tin.

Both ends 10-1 and 10-2 of the first winding wires 10 are coupled with the metal terminal of the first heave portion 103 and the third heave portion 105, respectively; and both ends 20-1 and 20-2 of the second winding wires 20 are coupled with the metal terminal of the second heave portion 104 and the fourth heave portion 106, respectively.

In one embodiment, the first flange 101, the second flange 102, the first heave portion 103, the second heave portion 104, the third heave portion 105, the fourth heave portion 106, the U-type heave portion 107 and the winding core 100 can be made by an integrated way to form the common mode filter 400. Hence, the overall structure of the common mode filter 400 is simple, fast assembly and easy operation.

Figure 6:
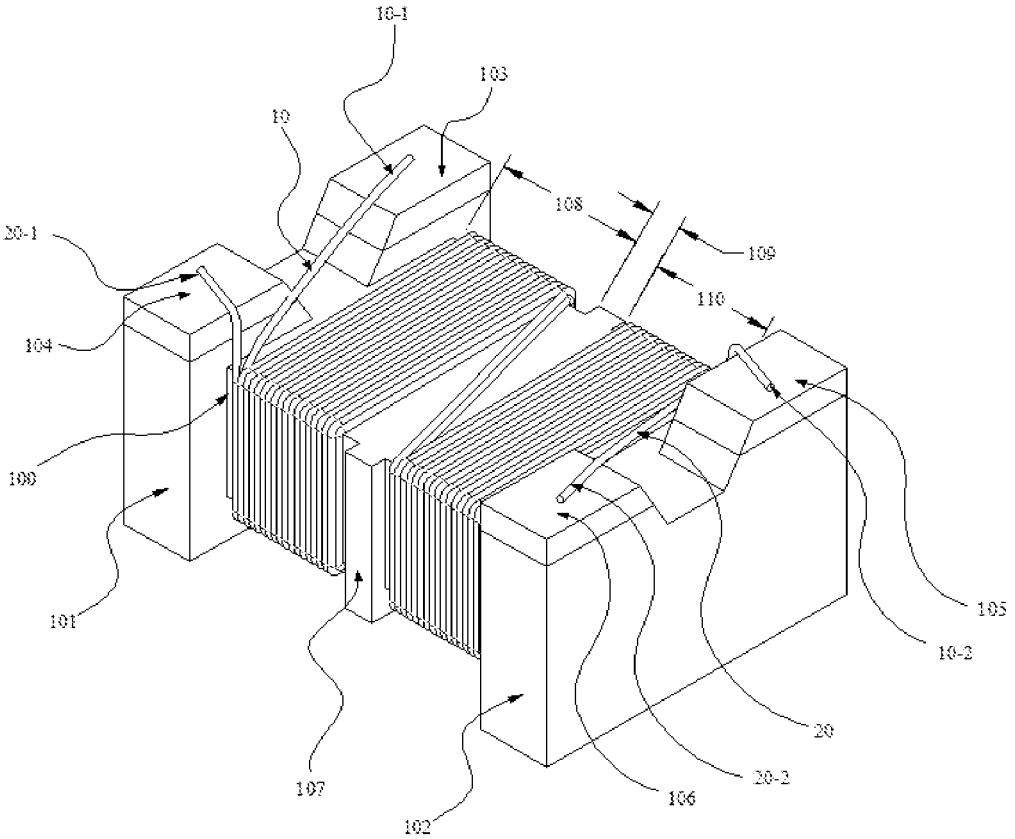
FIG. 6 illustrates a schematic perspective view of a common mode filter in accordance with the second embodiment of the present invention.
Figure 7:
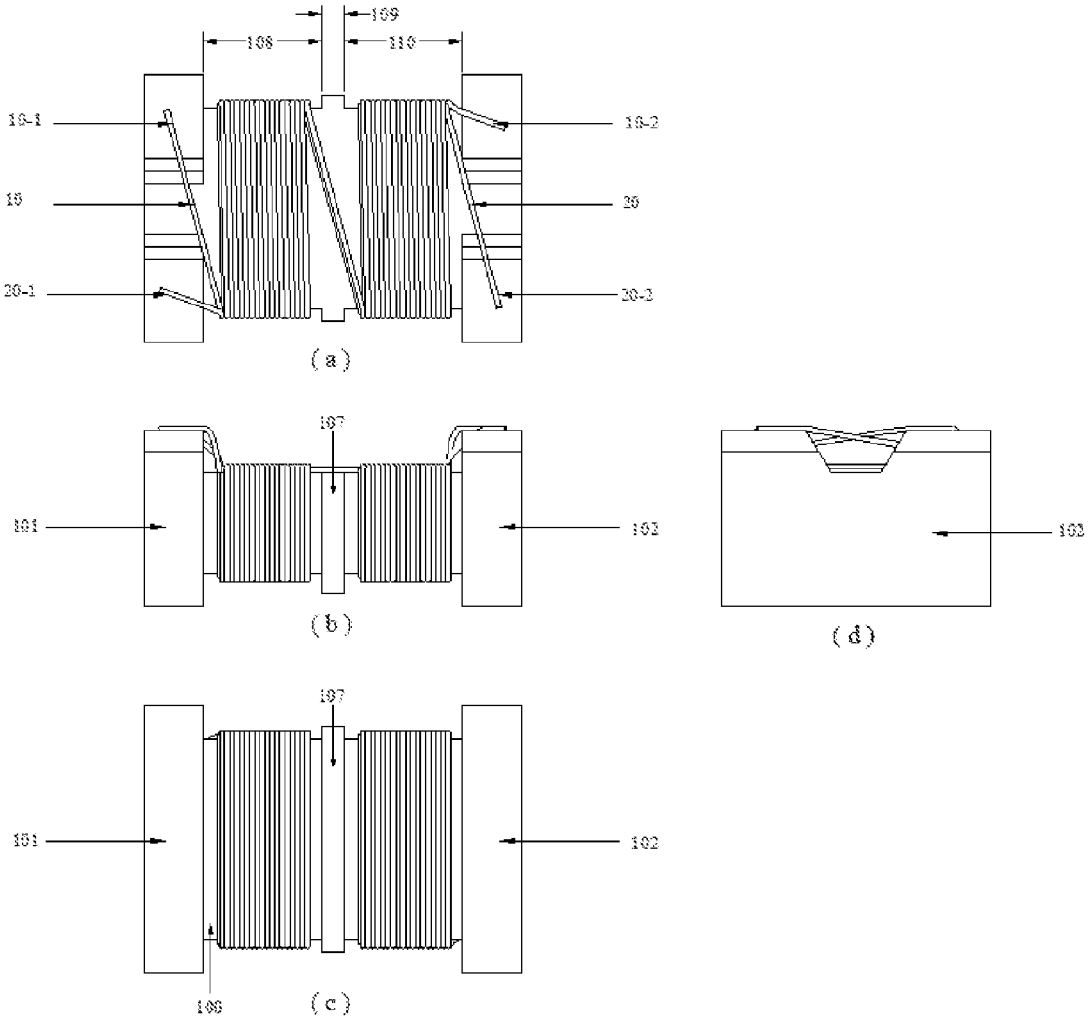
FIG. 7 illustrates plan views of the common mode filter shown in FIG. 6.

FIG. 6 illustrates a common mode in accordance with the second embodiment of the present invention 600. For clarity, FIG. 7 illustrates plan views of the common mode filter shown in FIG. 6, wherein FIG. 7 includes four figures: (a) down-sight view, (b) foresight view, (c) side-looking view, and (d) up-sight view.

The common mode filter includes a first flange 101 that includes a first heave portion 103 and a second heave portion 104; a second flange 102 that includes a third heave portion 105 and a fourth heave portion 106 and a winding core 100. The first flange 101 and the second flange 102 are configured at the ends of the winding core 100. In one embodiment, the winding core 100 further includes a U-type heave portion 107 and the U-type heave portion 107 that divides the winding core 100 into a first winding portion 108, a second winding portion 109 and a cross winding portion 110.

The material of the winding core 100 is Ferrite. In one embodiment, the Ferrite is nickel-zinc (Ni—Zn), manganese-zinc (Mn—Zn) or Ceramic.

In order to obtain two inductances magnetically coupled with each other and reduce the effects of the existence capacitors of in high-frequency layers and the inherent higher frequency characteristics of parasitic capacitors in the common mode filter 600, a first winding wires 10 and a second winding wires 20 are simultaneously and in parallel wound on the surface of the first winding portion 108, the cross winding portion 109 and the second winding portion 110 in sequence. In one embodiment, numbers of turns of the first winding wires 10 and the second winding wires 20 provided on the cross winding portion 109 are less than 1. In another embodiment, the numbers of turns of the first winding wires 10 and the second winding wires 20 provided on the winding core 100 are substantially the same.

The first heave portion 103, the second heave portion 104, the third heave portion 105 and the fourth heave portion 106 further include a metal terminal (not shown here). In one embodiment, the material of the metal terminal is composed by silver, nickel and gold or by silver, nickel and tin.

Both ends 10-1 and 10-2 of the first winding wires 10 are coupled with the metal terminal of the first heave portion 103 and the third heave portion 105, respectively; and both ends 20-1 and 20-2 of the second winding wires 20 are coupled with the metal terminal of the second heave portion 104 and the fourth heave portion 106, respectively.

In one embodiment, the first flange 101, the second flange 102, the first heave portion 103, the second heave portion 104, the third heave portion 105, the fourth heave portion 106, the U-type heave portion 107 and the winding core 100 can be made by an integrated way to form the common mode filter 600. Hence, the overall structure of the common mode filter 600 is simple, fast assembly and easy operation.

Figure 8:
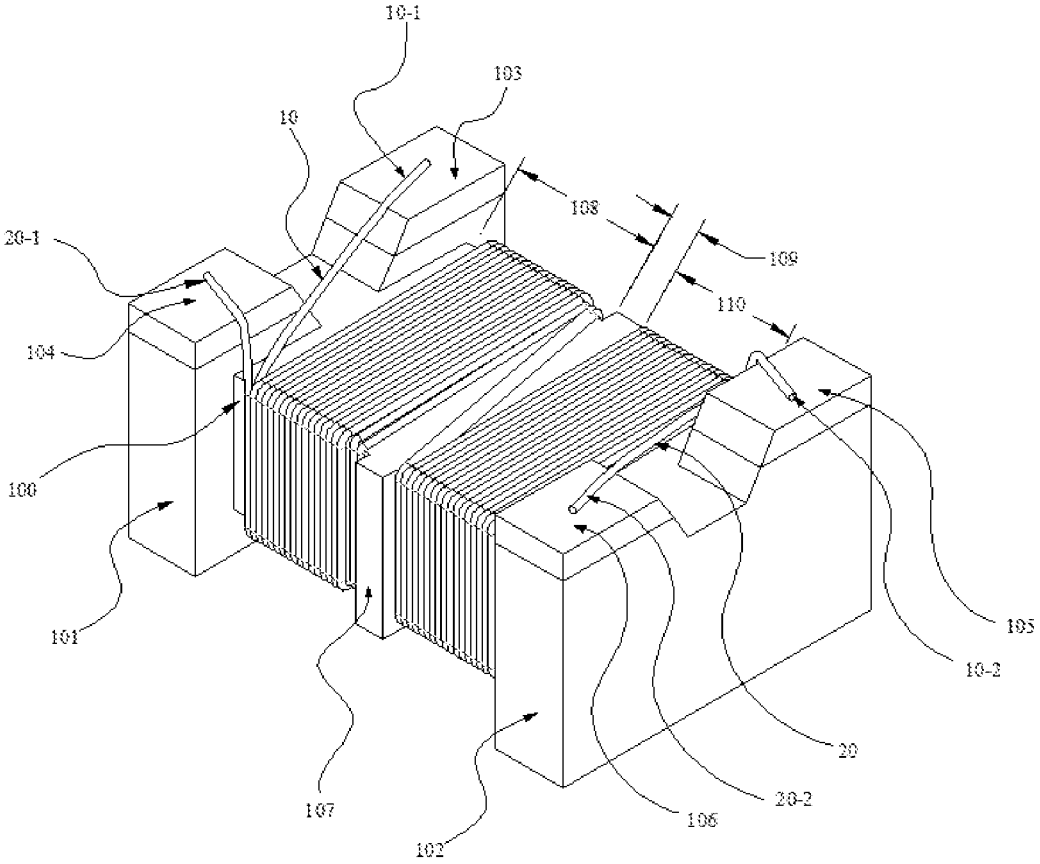
FIG. 8 illustrates a schematic perspective view of a common mode filter in accordance with the third embodiment of the present invention.
Figure 9:
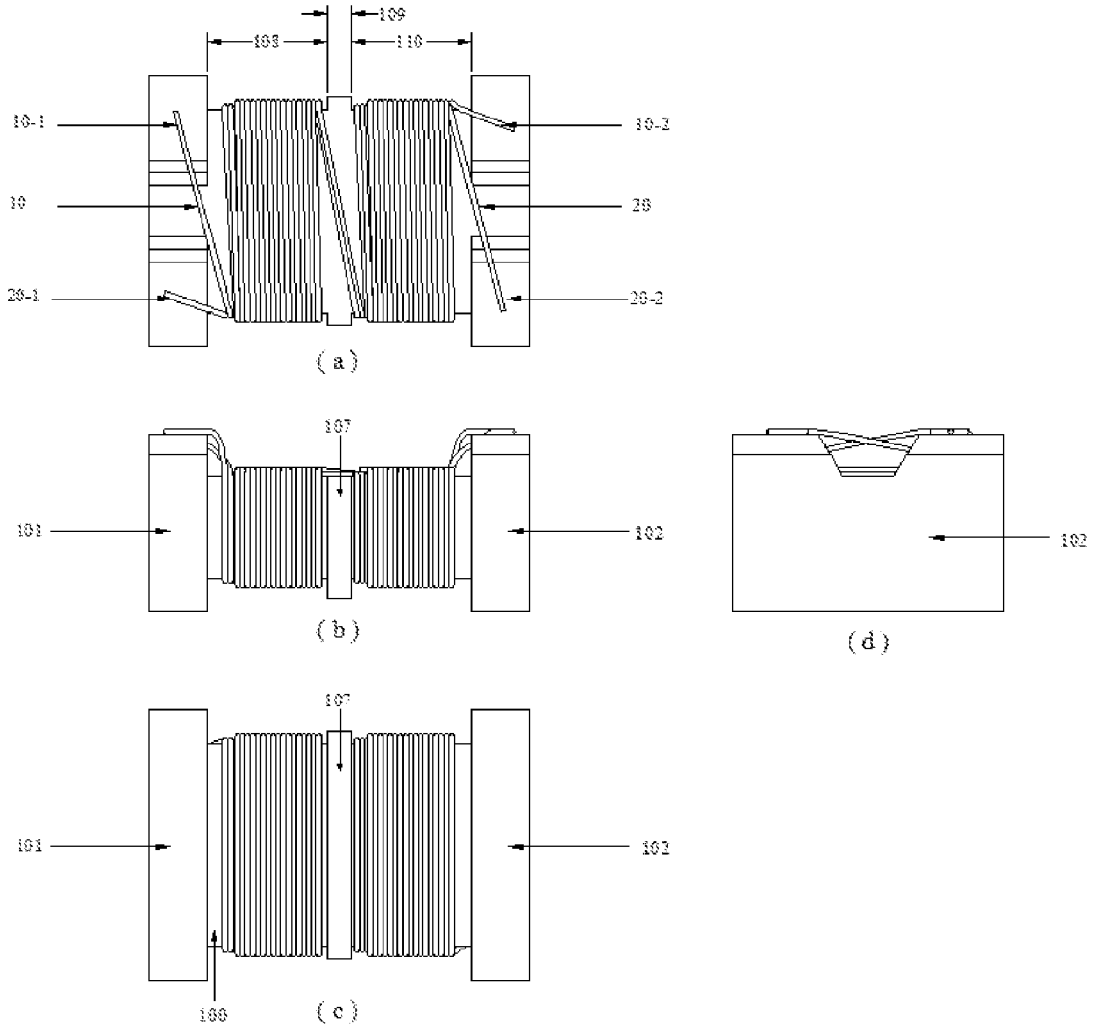
FIG. 9 illustrates plan views of the common mode filter shown in FIG. 8.

FIG. 8 illustrates a common mode in accordance with the third embodiment of the present invention 800. For clarity, FIG. 9 illustrates plan views of the common mode filter shown in FIG. 8, wherein FIG. 8 includes four figures: (a) down-sight view, (b) foresight view, (c) side-looking view, and (d) up-sight view.

The common mode filter includes a first flange 101 that includes a first heave portion 103 and a second heave portion 104; a second flange 102 that includes a third heave portion 105 and a fourth heave portion 106; a winding core 100, the first flange 101 and the second flange 102 are configured at the ends of the winding core 100. In one embodiment, the winding core 100 further includes a U-type heave portion 107 and the U-type heave portion 107 that divides the winding core 100 into a first winding portion 108, a second winding portion 109 and a cross winding portion 110.

The material of the winding core 100 is Ferrite. In one embodiment, the Ferrite is nickel-zinc (Ni—Zn), manganese-zinc (Mn—Zn) or Ceramic.

In order to obtain two inductances magnetically coupled with each other and reduce the effects of the existence capacitors of in high-frequency layers and the inherent higher frequency characteristics of parasitic capacitors in the common mode filter 800, a first winding wires 10 winding wires 10 are wound on the surface of the first winding portion 108, the cross winding portion 109 and the second winding portion 110 in sequence to form a winding surface layer. Next, the second winding wires 20 are wound on the winding surface layer from the first winding portion 108, the cross winding portion 109 and the second winding portion 110 in sequence. In one embodiment, at least a part of the second winding wires 20 are wound on the surface of the winding surface layer.

The numbers of turns of the first winding wires 10 and the second winding wires 20 provided on the cross winding portion 109 are less than 1. In another embodiment, the numbers of turns of the first winding wires 10 and the second winding wires 20 provided on the winding core 100 are substantially the same.

The first heave portion 103, the second heave portion 104, the third heave portion 105 and the fourth heave portion 106 further include a metal terminal (not shown here). In one embodiment, the material of the metal terminal is composed by silver, nickel and gold or by silver, nickel and tin.

Both ends 10-1 and 10-2 of the first winding wires 10 are coupled with the metal terminal of the first heave portion 103 and the third heave portion 105, respectively; and both ends 20-1 and 20-2 of the second winding wires 20 are coupled with the metal terminal of the second heave portion 104 and the fourth heave portion 106, respectively.

In one embodiment, the first flange 101, the second flange 102, the first heave portion 103, the second heave portion 104, the third heave portion 105, the fourth heave portion 106, the U-type heave portion 107 and the winding core 100 can be made by an integrated way to form the common mode filter 800. Hence, the overall structure of the common mode filter 800 is simple, fast assembly and easy operation.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A common mode filter, comprising:

a first flange, the first flange including a first heave portion and a second heave portion, wherein said first heave portion and said second heave portion define therebetween a first flange open portion on said first flange;

a second flange, the second flange including a third heave portion and a fourth heave portion, wherein said third heave portion and said fourth heave portion define therebetween a second flange open portion on said second flange;

a winding core, said first flange and said second flange configured at respective ends of said winding core, said winding core further comprising a U-shaped heave portion disposed between the first flange and the second flange, wherein said U-shaped heave portion and said winding core are integrally formed from the same material, said U-shaped heave portion dividing said winding core into a first winding portion, a second winding portion and a cross winding portion, said cross winding portion defined between two legs of said U-shaped heave portion and level with both the first winding portion and the second winding portion;

a first winding wire wound on said first winding portion, said cross winding portion and said second winding portion in sequence; and a second winding wire wound on said first winding portion, said cross winding portion and said second winding portion in sequence;

wherein a number of turns of said first winding wire and said second winding wire provided on said cross winding portion of said winding core is less than 1, said first winding wire crossing diagonally over said cross winding portion of said winding core and said second winding wire also crossing diagonally over said cross winding portion alongside said first winding wire, said first winding wire and said second winding wire are disposed on a surface of underlying structure of said cross winding portion of said winding core rather than being inlayed, said first flange, said second flange and said U-shaped heave portion are parallel with each other, and respective surfaces of the cross winding portion, the first flange open portion and the second flange open portion all face a same direction.

2. The common mode filter as claimed in claim 1, wherein said first winding wire and said second winding wire are wound on a surface of said winding core simultaneously, and a respective number of turns of said first winding wire and said second winding wire provided on said winding core are substantially the same.

3. The common mode filter as claimed in claim 1, wherein said first winding wire is wound on a surface of said core winding to form a winding surface layer; and at least a part of said second winding wire is wound on a surface of said winding surface layer, wherein, a respective number of turns of said first winding wire and said second winding wire provided on said winding core are substantially the same.

4. The common mode filter as claimed in claim 1, wherein said same material comprises nickel-zinc (Ni—Zn), manganese-zinc (Mn—Zn) or Ceramic.

5. The common mode filter as claimed in claim 1, wherein said first heave portion, said second heave portion, said third heave portion and said fourth heave portion each include a metal terminal, and a material of each said metal terminal comprises silver and nickel and further comprises at least one of gold and tin.

6. The common mode filter as claimed in claim 1, wherein ends of said first winding wire are coupled with said first heave portion and said third heave portion respectively; and ends of said second winding wire are coupled with said second heave portion and said fourth heave portion respectively.

7. A core of common mode filter, comprising:

a first flange, the first flange including a first heave portion and a second heave portion, wherein said first heave portion and said second heave portion define therebetween a first flange open portion on said first flange;

a second flange, the second flange including a third heave portion and a fourth heave portion, wherein said third heave portion and said fourth heave portion define therebetween a second flange open portion on said second flange; and a winding core, said first flange and said second flange disposed at respective ends of said winding core, and said winding core further including a U-shaped heave portion disposed between the first flange and the second flange, wherein:

said U-shaped heave portion and said winding core are integrally formed from a same material, said U-shaped heave portion divides said winding core into a first winding portion, a second winding portion and a cross winding portion, the cross winding portion defined between two legs of said U-shaped heave portion the cross winding portion level with the first winding portion and the second winding portion, and wherein said first flange, said second flange and said U-shaped heave portion are in parallel orientation, and the cross winding portion, the open portion of said first flange open portion and the open portion of said second flange open portion are all in the same direction.

8. The core of common mode filter as claimed in claim 7, said same material is Ferrite.

9. The core of common mode filter as claimed in claim 7, wherein said same material comprises nickel-zinc (Ni—Zn), manganese-zinc (Mn—Zn) or Ceramic.

10. The core of common mode filter as claimed in claim 7, wherein said first heave portion, said second heave portion, said third heave portion and said fourth heave portion each includes a metal terminal, and a material of each said metal terminal comprises silver and nickel, and further comprises one or more of gold and tin.

11. The common mode filter as claimed in claim 1, wherein the first flange open portion is level with a surface of said first winding portion and the second flange open portion is level with a surface of said second winding portion.

12. The common mode filter as claimed in claim 7, wherein the first flange open portion is level with a surface of said first winding portion and the second flange open portion is level with a surface of said second winding portion.

* * * * *